US010618685B2

(12) United States Patent
Leboucher

(10) Patent No.: US 10,618,685 B2
(45) Date of Patent: Apr. 14, 2020

(54) CLOSURE FOR A CONTAINER AND A CONTAINER PROVIDED THEREWITH

(71) Applicant: Ardagh MP Group Netherlands B.V., Deventer (NL)

(72) Inventor: Fabrice Leboucher, Angers (FR)

( * ) Notice: Subject to any disclaimer, the term of this patent is extended or adjusted under 35 U.S.C. 154(b) by 257 days.

(21) Appl. No.: 15/532,348

(22) PCT Filed: Nov. 24, 2015

(86) PCT No.: PCT/EP2015/077518
§ 371 (c)(1),
(2) Date: Jun. 1, 2017

(87) PCT Pub. No.: WO2016/087268
PCT Pub. Date: Jun. 9, 2016

(65) Prior Publication Data

US 2017/0361976 A1 Dec. 21, 2017

(30) Foreign Application Priority Data

Dec. 1, 2014 (EP) ..... 14195688

(51) Int. Cl.
*B65D 17/28* (2006.01)

(52) U.S. Cl.
CPC .. *B65D 17/4011* (2018.01); *B65D 2517/0016* (2013.01); *B65D 2517/0062* (2013.01);
(Continued)

(58) Field of Classification Search
CPC ..... B65D 17/4011; B65D 2517/0062; B65D 2517/0076; B65D 2517/0077
See application file for complete search history.

(56) References Cited

U.S. PATENT DOCUMENTS 3,441,171 A * 4/1969 Stec ..... B65D 17/4011 220/273
3,674,171 A 7/1972 Fahlbusch
(Continued)

FOREIGN PATENT DOCUMENTS

EP 2684808 1/2014
FR 2645121 10/1990
(Continued)

OTHER PUBLICATIONS

International Search Report and Written Opinion of the International Searching Authority of PCT/EP2015/077518, dated Feb. 17, 2016.

(Continued)

*Primary Examiner* — James N Smalley
*Assistant Examiner* — Madison L Poos
(74) *Attorney, Agent, or Firm* — Cook Alex Ltd.

(57) ABSTRACT

The present invention relates to a closure for a container, comprising, a tab attached by rivet means to a closure part to be displaced for forming an opening in the closure, which opening is at least partly defined by a score line formed in the closure, the tab comprises a tab body connected to the rivet means, a tab rear part for finger gripping, and a tab front part of which a tab nose is located near or at the score line, such that during a closure opening procedure comprising finger gripping the tab rear part, lifting the tab rear part thereby pressing the tab nose against the closure on or near the score line, popping the score line, and scoring the score line thereby forming an opening in the closure, characterized by score line parts separated by a score line part to be popped by the tab nose, which score line parts are stronger than the popping score line part, and by stiffening means stiffening closure parts neighboring the stronger score line parts, and to a container provided with such closure.

17 Claims, 4 Drawing Sheets

(52) U.S. Cl.
CPC ..... *B65D 2517/0076* (2013.01); *B65D 2517/0077* (2013.01)

(56) References Cited

U.S. PATENT DOCUMENTS

| | | | | |
|---|---|---|---|---|
| 3,735,892 | A | 5/1973 | Kinkel | |
| 3,843,012 | A | 10/1974 | Brown | |
| 3,858,753 | A | 1/1975 | Brautigam | |
| 3,891,117 | A * | 6/1975 | Dragomier | B65D 17/4011 220/270 |
| 4,406,378 | A * | 9/1983 | Zysset | B65D 17/4011 220/273 |
| 5,671,860 | A * | 9/1997 | Louwerse | B65D 17/163 220/273 |
| 5,964,366 | A | 10/1999 | Hurst et al. | |
| 6,427,860 | B1 | 8/2002 | Nishida et al. | |
| 6,889,862 | B2 | 5/2005 | Vaughan | |
| 7,000,797 | B2 | 2/2006 | Forrest et al. | |
| 7,891,519 | B2 | 2/2011 | Matsukawa et al. | |
| 2004/0056032 | A1 | 3/2004 | Vaughan | |
| 2013/0026169 | A1 * | 1/2013 | Burleson, Jr. | B65D 7/36 220/270 |

FOREIGN PATENT DOCUMENTS

| | | |
|---|---|---|
| JP | 2004161360 A | 6/2004 |
| WO | PCT WO 2014/009195 | 1/2014 |

OTHER PUBLICATIONS

International Preliminary Report on Patentability of PCT/EP2015/077518, dated Jun. 6, 2017.

* cited by examiner

CLOSURE FOR A CONTAINER AND A CONTAINER PROVIDED THEREWITH

CROSS REFERENCE STATEMENT

This is a National Phase of PCT/EP/2015/077518, filed Nov. 24, 2015, which claims priority from European Patent Office Application No. 14195688.8, filed Dec. 1, 2014, each incorporated by reference hereinto.

FIELD OF THE DISCLOSURE

The present invention relates to a closure for a container, and to a container provided with such a closure.

The present invention relates to a closure for a container and in particular to a closure for an easy opening container. An easy opening container is a container which the consumer can open without the use of a tool. Thereto, the easy opening container is provided with a closure having a tab with which the consumer is able to form an opening in the closure along a score line, and subsequently at least partially to remove the closure part provided with the tab thereby forming an opening in the closure and to make access to the container content. The container opening procedure to be followed by the consumer comprises first a lifting of the tab at its tab rear part from the closure surface whereby the tab will rotate or lever, and the tab nose will press near or on the score line. The score will fail thereby popping open the closure. Further rotation or levering of the tab until its substantially vertical position will result in forming the intended opening. The construction of the tab is such that the rotational or levering force for lifting the tab and for forming the initial opening in closure should be sufficiently low for easy opening. Thereafter, with the tab in an upright position the consumer may pull the tab thereby tearing the closure part attached to the tab loose from the remainder of the closure so that the closure part is torn along the score line apart from the closure thereby forming the maximum opening.

Obviously, not only the rotational force for lifting the tab but also the opening tear force should be sufficiently low in order to acquire easy access to the content of the closure.

BACKGROUND OF THE DISCLOSURE

Generally, a closure for a container of the type as described above comprises a tab which is attached at the tab body by rivet means to the closure. The rivet means should be such that the tab is reliably attached to the closure and will not fail or even release during the lifting or tearing of the closure part during the opening of the container and thereby being separated in an undesired manner from the closure part. Such a situation is not desired and even dangerous because generally the torn score line comprises a sharp torn edge.

For a reliable and easy popping open of the closure it is preferred that the area where the initial opening of the closure occurs is relatively stiff because a stiff will be easier to pop open than a flexible closure. However, due to the structural elements present in the closure for attaching the tab via the rivet means to the closure part this area of the closure is generally stretched and relatively thin and vulnerable, particularly when the rivet means are made from the closure part material and are integral with the closure part. In addition, when the content of the closure is pressurized, it should be avoided that when having a weaker area an undesired opening by peaking could occur.

The above considerations require a tab to be reliably attached by the rivet means to the closure part, for having an easy opening of the container with the tab and without a tool. Preferably such container is also suitable for containers comprising pressurized contents. In view of these considerations, the skilled person will acknowledge that the area were the tab nose will act on the score line for popping open the closure and forming a so-called opening chord along the score line, is an area full with compromises for balancing conflicting constructional features. The closure should be easily opened but still sufficiently rigid for withstanding internal pressures and easy popping. Therefore, this delicately designed area is unlikely for the skilled person to include or be imparted further construction measures in relation to an improvement of the opening of a closure as described above, but which may interfere with the existing easy opening construction.

SUMMARY OF THE DISCLOSURE

The construction of the closure is such that it can be applied for containers of which the content is subjected a (steam) cooking treatment or sterilization treatment before mounting the closure on the container comprising the hot content. Such heat treatment becomes more popular with the introduction of new recipes for preparing vegetables. Then after cooling the content a subatmospheric pressure will be present in the closed container. Such subatmospheric pressure may amount to 0.5 to 0.9 bar. The opening of the container will result in an implosion accompanied by a loud "bang". If frightened by the load bang the consumer may spoil contents of the container. A hissing sound of sudden gas entering the container may also be noticed by the consumer. These uncommon, surprising and even frightening experiences when opening the vacuum contained, may lead the consumer to conclude that the quality of the content is deteriorated or even degraded.

The present invention has for its object to reduce or even avoid the occurrence of such implosion and load noise that may frighten the consumer and/or allegedly indicate bad content quality gas release. So that the consumer unaware of the vacuum in the container, when opening the container does not or to a minor extent experiences the effects of the pressure equalization.

The present invention is based on the insight that by controlling the opening procedure, and more in particular the rate of scoring the score line of the container, such that first a small initial opening is formed during popping, gas equalization can occur while avoiding or to a minor extent occurs an implosion with related undesired phenomena. The rate of scoring is to be retarded because once the score line is punctures at a relatively high popping force, further scoring requires less or even no additional force exerted by the tab nose, due to the pressure difference over the closure an inwardly directed force will accelerate further scoring and opening of the contained. Thus, as soon as the score line is popped, the container opens rapidly accompanied by the implosion and described results.

The rapid progression of opening of the closure is countered by retarding the rate of scoring the score line. This may be accomplished by increasing the force required for scoring the score line, i.e., by making the score line stronger. But this will inherently have several negative effects on the performance of the closure properties. First, a stronger score line will result in more force to be exerted on regions of the closure neighboring the score line. These regions are not designed to withstand such additional force, and will deform. This deformation will have a negative effect on the opening procedure as the additional force to operate on the stronger score line is lost in deformation and collapse of the closure structure. Secondly, a stronger score line will require a higher initial popping force for creating an initial opening in the closure. This initial popping force is experienced by the consumer in a higher or even too high initial opening force. Thus, this negatively interferes with the opening properties of the closure.

But such control of the rate of scoring the score line should be such that the related structural modifications of the closure should not or only to a minor extent interfere with the other essential or desired properties of the closure and its closure opening procedure.

Moreover, the structural modifications should be such that the modified closure is easy the produce using traditional tools, at the same high production speed and with no or a reduced amount of additional material (such as having the same wall thickness) for making the closure.

This object or problem of substantially avoiding the occurrence of an implosion and related undesired effects as much as possible, while production and costs are substantially not increased, is solved with a closure of the present invention. Such closure for a container of the invention, comprises, a tab attached by rivet means to a closure part to be displaced for forming an opening in the closure, which opening is at least partly defined by a score line formed in the closure, the tab comprises a tab body connected to the rivet means, a tab rear part for finger gripping, and a tab front part of which a tab nose is located near or at the score line, such that during a closure opening procedure comprising finger gripping the tab rear part, lifting the tab rear part thereby pressing the tab nose against the closure on or near the score line, popping the score line, and scoring the score line thereby forming an opening in the closure, characterized by score line parts separated by a score line part to be popped by the tab nose, which score line parts are stronger than the popping score line part, and by stiffening means stiffening closure parts neighboring the stronger score line parts.

Thus, when opening the container by the consumer following the standard closure opening procedure at normal opening force (such as acted on the conventional residual thickness of the popping score line part), the score line is scored by popping the score line part to be popped, followed by scoring in circumferentially opposite directions along the stronger score line parts. The initial scoring or popping is enhanced by the pressure difference due to the internal vacuum. Further scoring of the stronger score line parts requires more force and the enhancing effect on scoring by the pressure difference is compensated by the greater scoring force required. Thus, the opening force to be generated by the consumer may not be greater or even the same as conventional.

The required greater scoring force will have substantially no effect on closure parts neighboring the stronger score line parts, because these neighboring closure parts have been made stronger (or stiffer) by the presence of stiffening means. So that essentially the full scoring force for scoring the stronger score line parts is effectively used for scoring and not for undesired deforming the neighboring closure parts.

Although there are several options for increasing the strength of the stronger score line parts, such as changing the metallurgy, i.e., use a softer material, or adapt the profile of the score, it is preferred that the stronger score line parts have a residual thickness (r) which is greater than the residual (rp) thickness of the popping score line. Accordingly, the strength of the score line parts can be easily and simply adjusted with the same tools forming the score line the residual thickness. For instance the stronger score line parts may have a residual thickness (r) is in the range of 40-90 μm, preferably of 45-80 μm, such as 50-75 μm. This has as a preferred result that the difference between r and rp is at least 5 μm, preferably at least 10 μm, or 15 μm, such as in the range of 5-40 μm, preferably 10-35 μm, more preferably 15-30 μm. Notably the residual thickness may also vary over the length of the stronger score line parts, such as in a direction remote of the popping score line part gradually decreases and thus less strong. Although the length of the stronger score line part may have the same length as the arced part of the opening, it appeared practical that the stronger score line part has a length in the range of 5-3 mm, preferably 10-20 mm. the length of the popping score line part is generally in the range of 2-20 mm, or 5-10 mm. The skilled person will appreciate that for containers with different diameters and shape in cross section different residual thicknesses, and lengths may be selected. Thus, a shorter stronger score line part, such as having a length of 13 mm, and a delta residual thickness (r-rp) of 30 μm, may provide the same result of the inventions, as a length of 18 mm and a delta residual thickness (r-rp) of 20 μm; for a container with a diameter of 83 mm. Larger diameters, such as 99 mm and up to 153 mm, a greater length. For smaller diameters, such as 52 mm, 56 mm and 73 mm, generally the reverse is applicable.

For the compensation of the use of stronger score line parts according to the invention, and avoiding deformations and deterioration of the neighboring closure parts, which will negatively influence the opening properties of the closure the invention relates to the provision of stiffening means for stiffening parts of the closure that neighbor the stronger score line parts.

According to a preferred embodiment stiffening means comprise at least one elongated stiffening elements at both sides of the rivet means. When the length of the stronger score line parts so requires the stiffening means comprise preferably two or more elongated stiffening elements at both sides of the rivet means.

According to a preferred embodiment, the elongated stiffening elements are straight. These stiffening elements are oriented cross and preferably perpendicular, or radially relative to the score line. The elongated stiffening elements increase the resistance the rigidity or strength of the closure regions neighboring the stronger score line parts.

According to an alternative embodiment of the elongated stiffening elements the form of the elongated stiffening elements is straight. In relation to this alternative a preferred embodiment the straight stiffening elements are parallel to each other at one side of the rivet. This provides a scoring process that will proceed at both sides of the rivet in substantially the same and balanced manner, so that the ultimate opening is formed at both sides at substantially the same time and with the same form. This is very important, if ultimately using the tab the part encircled by the score line is to be torn off from the remainder of the closure on the container.

The closure opening procedure is highly balanced when preferably the stiffening elements are parallel to each other at both sides of the rivet. Moreover, the initial popping and scoring of the score line, particularly at larger diameters of the container, such as at 73 mm, 99 mm, and 153 mm, is further improved if the straight stiffening elements converge relative to the straight stiffening elements at the other side of the rivet. Accordingly, the effect of the stiffening elements on the score line is already present close to or in the area between the rivet and the score line.

In an alternative embodiment the stiffening elements are curved and/or hooked. For the same reasons as given above for the straight stiffening element these curved or hooked stiffening elements may be concentric, and preferably (for the curved shape) concentric with the rivet means as the center.

In the above description, the stiffening means and elements of the invention are located radially inwardly of the score line. However, the effects of the present invention are equally accomplished when the stiffening means (such as the stiffening elements) are located radially outwardly of the score line, provided that such location does not interfere with the essential functioning of the easy opening closure, but also in relation to its mounting on, and connection to the container body. Still it is preferred that the stiffening means located radially inwardly of the score line contact or extend beyond the score line. This contact and even extension beyond the score line should be accomplished without interference with the scoring function and scoring properties, i.e., pre-scoring is avoided. The provision of a junction of the score line with the stiffening elements of is incorporated by the stiffening means requires adapted forms of the stiffening elements such as gradual and continuous changes in shape, while avoiding abrupt structural changes. But due to the greater residual thickness (r) a junction or passage of the stiffening elements is relatively easy and safely accomplished.

In another embodiment of the closure of the invention, the closure comprises a groove extending radially inwardly along the score line, and the retarding means extend into or beyond the groove. For the formation of such junction or crossing of the groove and the stiffening element, similar constructional consideration apply as described above for the junction and crossing of the stiffening elements and the score line.

In an alternative embodiment of the stiffening means of the invention the retarding means comprise stiffening elements extending parallel to stronger score line parts, and the length (L) of the indentation or projection parallel to the stronger score line part is greater than width (W) of the element, such as equal or shorter than the length of the stronger score line part neighbored. Thus, in comparison to the stiffening elements extending cross or radially relative to the score line, these stiffening elements extend along (and preferably parallel) to the score line. For an optimal stiffening it is preferred when these stiffening elements have a form of which the ratio of L/W is greater than 1, preferably greater than 1.5, such as in the range of 1.5-10, such as 3-7.

Although not required for the essential effect of the invention, it is generally preferred for stability and strength of the score line, when preferably the score line extends circumferentially along an outer edge of the closure.

Another aspect of the invention relates to a container provided with a closure as described above for its structural characteristics.

In relation to the closures of the invention it appeared advantages for a proper and reliable functioning of the closure during production, storage, and mounting of a container that beneficial structural characteristics are incorporated. The closure for a container according to the invention may comprise at least one groove which extends along the score line. If this groove extends along the score line which encloses the groove, then it is preferred that the stiffening means are connected to this groove. This will provide for the area neighboring the stronger score line parts with an increased stiffness which may change only gradually in stiffness, whereas the stiffening means and the groove may be formed in the closure during the same forming operation. In a preferred embodiment the groove is a circumferential groove which partially or preferably substantially encloses the removable closure part of the closure.

Advantageously, the closure is provided with two circumferential grooves each extending at a side along the score line. Such closure has a high strength. The scoring may be done at a relatively low scoring force and even may result in a use of a less thick closure material.

It should be noted that the score line may be a closed score line so that the closure part may be displaced and removed entirely from the closure and becomes eventually separated from the closure. Such score line may be circular, ellipsoid, or any suitable form. On the other hand, the invention also relates to a score line which is not a closed score line, so that the closure part to be displaced for forming the opening will remain attached to the closure in an area where the closure is not provided with the score line. Such score line may have to form of a crescent or other suitable form.

The rivet means may comprise a separated rivet which is formed in the closure via a rivet opening formed in the closure, so that the rivet is extending through this rivet opening and attaches the tab to the closure. In a preferred embodiment the rivet means have the form of a rivet made from the material of the closure, so that the rivet means are integrally formed from the closure part. Such integral forming requires the provision of closure material for the rivet means by stretching additionally the closure adjacent the area where the rivet means are to be formed integrally from the closure material. Evidently, such integral rivet means has the advantage of providing a closure not having an opening for the rivet.

It is preferred, that the stiffening means have the form of an elongated indentation of projection, which may be formed in the material during the formation of the closure. Such a indentation or projection may be open to the inner side of the container but preferably open to the tab side of the closure part, so that it will have a form similar to other structures formed in the closure for the same or other reasons. Such other forms may comprise a terrace structure, dimples form supporting the tab rear part, and evidently furrows and serpentine furrows for increasing the strength of the closure.

The tear force for opening the closure is generally measured and tested with a tear force opening test. In the testing apparatus the tab is connected to the pulling element and preloaded (pre-load about 1N). The closure is rotated over about 90° whereby the tab is brought into an upright position and the closure is popped open. The detected maximum force is the pop force. The tab is pulled against the rim of the closure and then the closure is rotated back to the tear position at about 4°. The tab is then pulled and the detected maximum force is the tear force. Tests with a closure for a container according to the invention have shown that the tear force for opening the closure is reduced by for instance 5-15N, when compared with a closure devoid of the stiffening means of the invention requiring an opening tear force of about 40-60N for a 73 mm diameter round steel easy opening closure. Preferably but not essentially, the invention allows for the formation of a longer chord (or arc) resulting in a reduction of the opening tear force.

BRIEF DESCRIPTION OF THE FIGURES

Mentioned and other features and characteristics of a closure and container according to the present invention will be further elucidated and discussed with reference to the following embodiments which are given for information purposes only without an intention to restrict the invention further. In relation to such a description reference will be made to the figures wherein.

DETAILED DESCRIPTION OF THE ILLUSTRATED EMBODIMENTS

Figure 1:
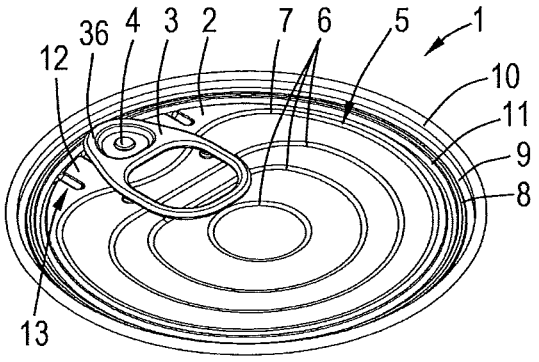
FIG. 1 shows a perspective view of a closure of the invention.
Figure 3:
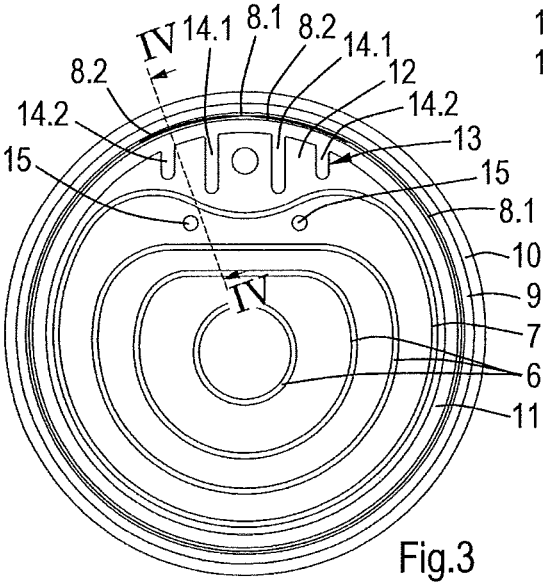
FIG. 3 is the top view of FIG. 2 without the tab.
Figure 4A:
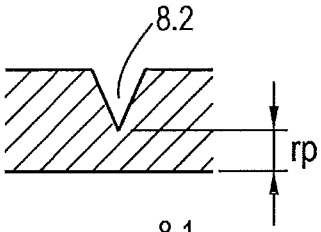
FIG. 4 is a cross section along the line IV-IV of FIG. 3, and FIGS. 4A and 4B at higher magnification cross sections at the popping score line and at the stronger score line part, respectively.
Figure 4B:
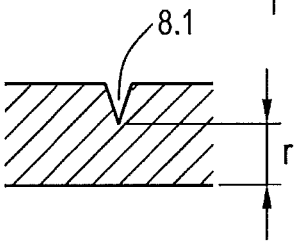
Figure 4:
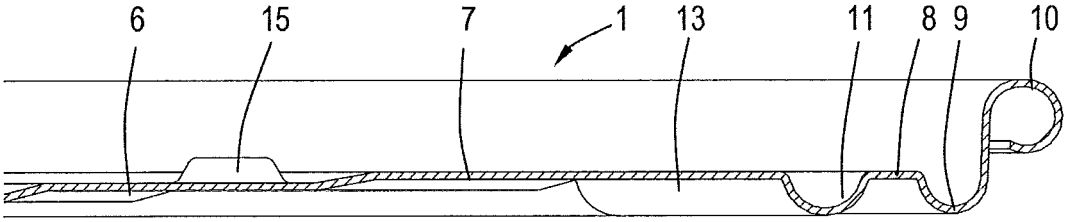
Figure 5:
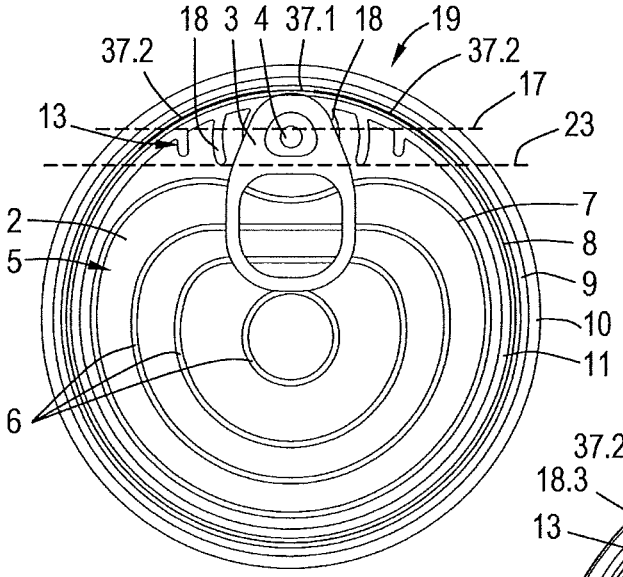
FIG. 5 is a top view of a closure of the invention with the longer opening arc of the invention in comparison to the indicated opening arc of FIG. 2.
Figure 6:
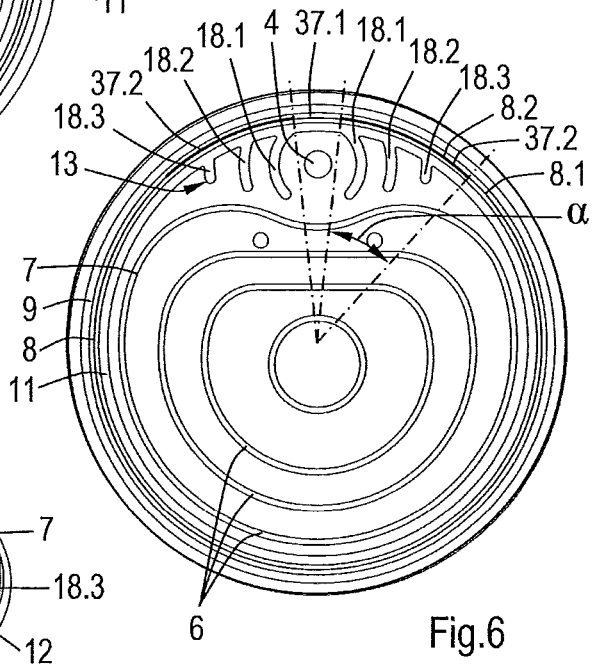
FIG. 6 is a top view of the closure of FIG. 5 without the tab.
Figure 7:
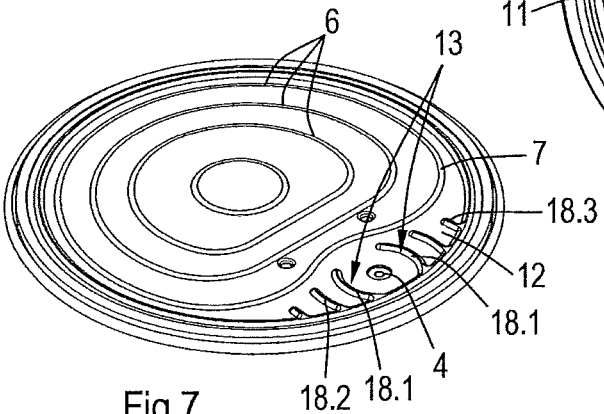
FIG. 7 is a perspective view of the underside of the closure of FIG. 5 of the invention.

FIG. 1 shows a closure 1 of the prior art. The closure 1 comprises a (partially) displaceable closure part 2 to which is attached a tab 3 via a rivet 4. The closure part 2 has a terrace structure 5 defined by terrace steps 6 and a surrounding substantially circular step 7 radially inwardly curved in the region of the rivet 4. The removable closure part 2 is surrounded by a circular score line 8. The score line 8 comprises a popping score line part 8.1 near the nose 36 of the tab 3 and having a residual thickness rp of typically 65 μm and a length of 5 mm, and two stronger score line parts 8.2 having a residual thickness r of 65 μm+30 μm and a length of 13 mm, separated by the popping score line part 8.1 located in the popping area. Along the score line 8 are extending an outer circular groove 9 connected to a curl 10 for connection to a container body (not shown), and an inner circular groove 11 (see FIGS. 2, 3 and 4). The step 7 comprises a curved part 12 thereby providing space for the rivet 4 which is integrally formed from material of the closure part 2. Furthermore, are present dimples 15 supporting the tab 3.

The closure comprises stiffening means 13 in the form of elongated stiffening elements 14 oriented cross to the groove 11 and the score line 8. At both sides of the rivet 4 there are two straight and parallel stiffening elements 14.1 and 14.2 with a length decreasing in a direction remote of the rivet 4, or in the alternative with a length increasing in the remote direction, see also FIGS. 16 and 17. The stiffening elements have the form of grooves 14 which are open to the tab side of the closure 1. The stiffening elements 14 are connected to, and opened into the groove 11. The stronger score line parts 8.2 extend beyond of the stiffening elements 14.1 and 14.2.

Figure 2:
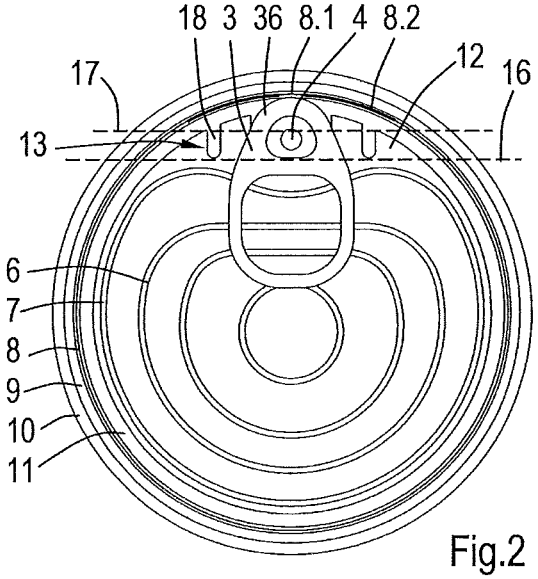
FIG. 2 is a top view of the closure of FIG. 1 with the tab and by an interrupted line the opening arc.

FIG. 2 shows the opening chord 16 that moved further to the center of the closure due to the presence of the stiffening elements 14 in comparison to the folding line 17 formed in the absence of the stiffening elements 13, when the tab 3 is lifted and the score line broken over the score line arc 18. bounded by the interceptions of the score line 8 with the folding line 17. The tear force for opening the closure 1 when mounted on a container body with a diameter of 73 mm is about 45N.

FIGS. 5-8 show a closure 19 according to the invention. The same structural elements for this closure 19 which are also present and discussed in relation to the closure 1 are identified with the same reference numbers. Closure 19 comprises a closure part 2 to which is attached the tab 3 via the rivet 4. The closure part 2 has a terrace structure 5 defined by the steps 6 and 7. The terrace structure 5 is surrounded by the step 7. The closure part 2 is delineated by the circumferential score line 8. The grooves 9 and 11 extend at each side of the score line 8 around the score line 8. Also present are curved stiffening elements 18.1-3 extending on hypothetical circles laterally of the rivet 4 and the rivet 4 as the circles centre.

The closure 19 according to the invention differs from the closure 1, in that stiffening means 13 in the form of curved stiffening elements 18 extend along the rivet 4 towards the score line 8, and close to or in the area between the rivet 4 and the score line 8. The stiffening elements 18 have the form of grooves 18 extending sidewise of the rivet 4 towards the score line 8 and contact the inner groove 11. The effect of the presence of the stiffening elements 18 is, that the area neighboring the score line 8 is stiffer. The popping score line part 37.1 has a residual thickness (rp) of typically 65 μm, and a length of 5 mm, separates the stronger score line parts 37.2 having a residual thickness (r) of 20 μm extra as compared to rp, and a length of 18 mm. The folding line 23 along which is section 25 of the closure part 2 is folded inwardly after popping and scoring the score line 8 at different scoring force due to the presence of the stronger score line parts 37.2, neighbored by the stiffening elements 18.1-3, thereby forming an opening 24, is now transferred more towards the center of the closure 19 such that the opening chord 26 defined in between the intersection of the folding line 23 with the score line 8 is larger than that with the folding line 17 as discussed in relation to FIG. 2.

It is evident, that due to the presence of three stiffening elements 18 the in the closure 19 according to the invention, that the folding line 23 is transferred more to the center of the closure 19. Accordingly, the opening chord 26 as defined in between the intersections of the folding line 23 with the score line 8 is longer than the opening chord 16 as defined between the intersections of the folding line 17 with the score line 8. With the result that the tear force for opening the closure 19 when mounted on a container body with the diameter of 73 mm is about 45N at about 65 μm residual (rp).

Hereafter are discussed various embodiments of the invention showing still other different types of stiffening elements according to the invention. The embodiments of the closure 20, 21 and 22 comprise elongated stiffening grooves that contact and open into the inner groove 11 which is parallel to the score line 8.

Figure 8:
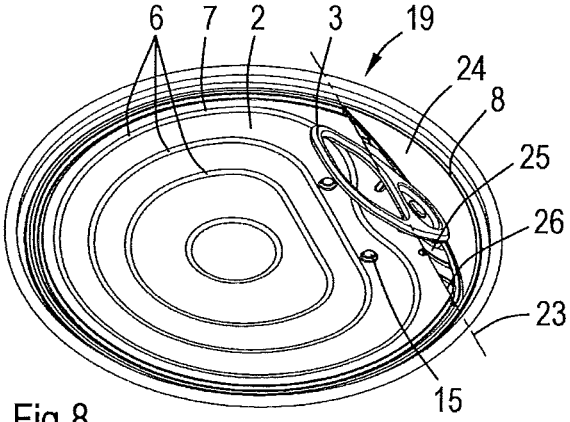
FIG. 8 is a perspective view of the closure of the invention of FIG. 5 after opening and forming of the opening chord.
Figure 9:
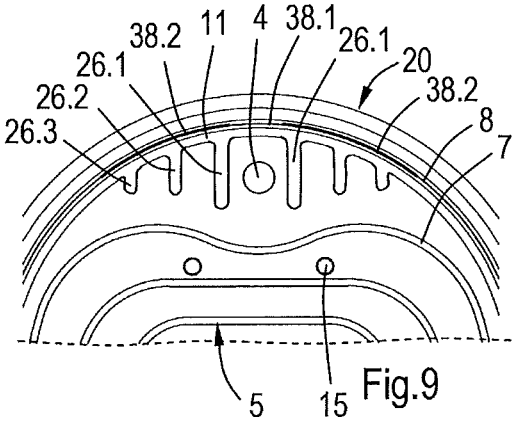
FIGS. 9-15 are top views according to FIG. 6 of alternative embodiments of the closure of the invention.

As discussed in relation to the FIGS. 5-8, and further shown in detail in FIG. 9, the closure 20 according to the invention comprises elongated and straight stiffening elements 22 extending laterally at both sides of the rivet 4 towards the score line 8 and open into the groove 11. The stiffening elements 26.1-3 are oriented cross to and open into the groove 11. The length of the stiffening elements decreases from the inner stiffening element 26.1 via the stiffening element 26.2, towards the stiffening element 26.3. The change in properties such as strength, in the area of the groove 11 and the score line 8, will result in a stiffening the area neighboring the stronger score line parts 38.2 separated by the popping score line part 38.1, near the stiffening elements 26.1-3, and thus in a stiffening in forming the ultimate opening in the closure 20.

Figure 10:
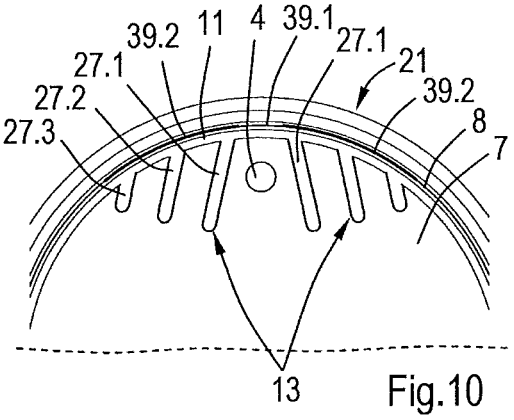

The closure 21 according to the invention as shown in FIG. 10, comprises the stiffening elements 27 in the form of grooves 27.1-3 according to the invention. The stiffening elements 27 are at both sides mutually parallel, and from both sides of the rivet 4 converge with the stiffening elements 27.1 close to or into the area between the rivet 4 and the groove 11 and the score line 8. This results in stiffening the neighboring area along the stronger score line parts 39.2 separated by the popping score line part 39.1 spanning the popping area in front of the tab (not shown). The closure 21 does not comprise a terrace structure 5, so that the length of the stiffening elements 27 may be extended when appropriate.

Figure 11:
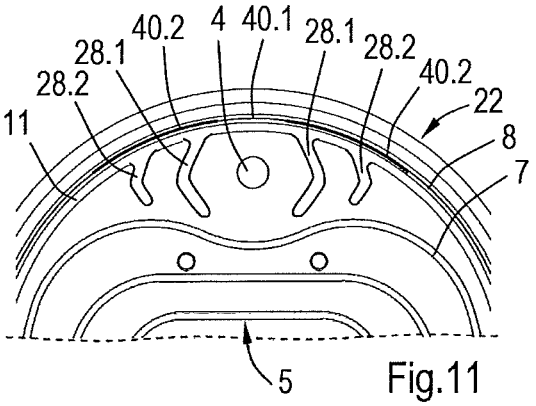

The closure 22 according to the invention as illustrated in FIG. 11 comprises stiffening means 13 which have the form of hooked stiffening grooves 28.1 and 28.2. They extend laterally of the rivet 4 and contacts the groove 11 close to and radially inwardly of the score line 8. These stiffening elements 28 again strengthen the area neighboring the stronger score line parts 40.2 separated by the popping score line part 40.1.

Figure 12:
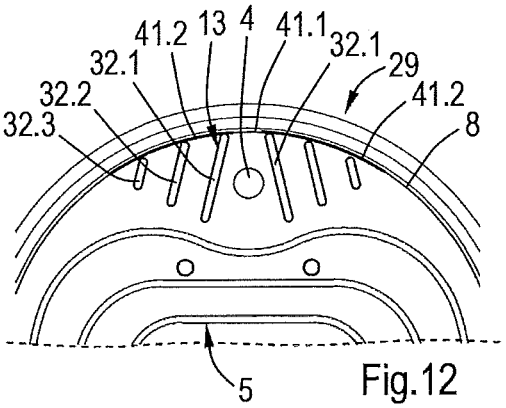
Figure 13:
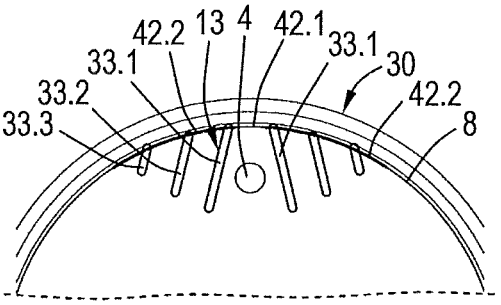
Figure 14:
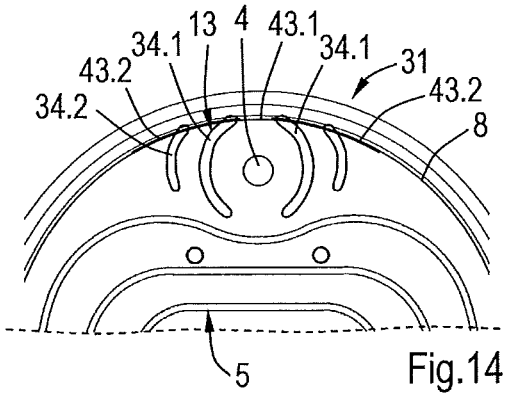

The closures 29, 30 and 31 shown in FIGS. 12-14 relate to embodiments of the closures of the invention in which the stiffening means contact (FIG. 12) or extend beyond (FIGS. 13 and 14) the score line 8. This is possible because the groove 11, as for instance discussed in relation to the closures of FIGS. 1-11, is not present. Although the skilled person will appreciated that such groove 11 may be present without deteriorating the desired effect of the invention, which is strengthening the area neighboring the stronger score line parts.

The closure 29 according to the invention as illustrated in FIG. 12 comprises stiffening means 13 according to the invention, having the form of stiffening grooves 32 which extend laterally and parallel of the rivet 4 and converges with the stiffening grooves 32.1 extending (partly) in front of the rivet 4 but are in contact with the score line 8 in the stronger score line parts 41.2 having a greater residual thickness (r) than the residual thickness (rp) of the popping score line part 41.1. The contact of the stiffening grooves 32 with the stronger score line parts 41.2 is accomplished such that the properties of the score line 8 are not negatively affected.

The skilled person will appreciate, that in an alternative to the embodiment of the closure 30 as shown in FIG. 13, that the stiffening elements 33 have the same form and mutual orientation as the stiffening grooves 32 of the closure 29 of FIG. 12, but the stiffening elements 33 not only contact the score line 8 at the stronger score line parts 42.1 separated by the popping score line part 42.1, but also extend radially outwardly and beyond the stronger score line parts 42.2. Whereby the presence of the stiffening elements 33 is substantially greater than when only contacting the score line 8. But the formation of the contacting and crossing stiffening elements 33.1-3 and the stronger score line parts 42.2 of the score line 8 is delicate but technically feasible because of the residual thickness (r) of the stronger score line parts 42.2. It is noted, as will be appreciated by the skilled person that these stiffening elements 33 may also run in parallel or have a curved or serpentine form and intersect with the score line 8 at different angels. Also a terrace structure 5 may be present.

The closure 31 of the invention as shown in FIG. 14 comprises concentric partially circular stiffening elements 34.1 and 34.2 extending at both sides of the rivet 4 and extend up to and beyond the stronger score line parts 43.2 of the score line 8. The stiffening elements 34.1 may further than shown extend in the area between the rivet 4 and the popping score line part 43.1 of the score line 8.

Figure 15:
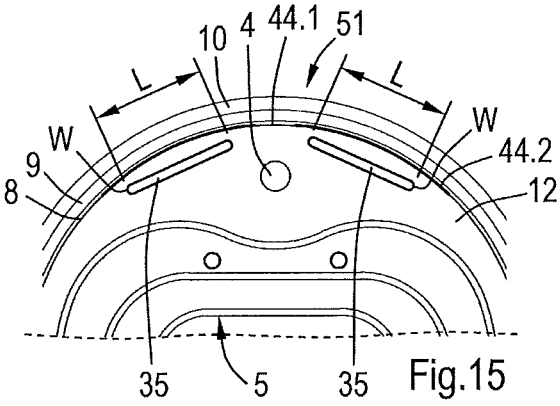

In an alternative embodiment of the stiffening means 13 of the invention as shown in FIG. 15, the stiffening means comprise stiffening elements 35 extending parallel to the stronger score line parts 44.2 of the score line 8, and the length (L) of the indentation or projection parallel to the score line 8 is greater than width (W) of the stiffening elements. Thus, in comparison to the stiffening elements extending cross or radially relative to the score line, these stiffening elements 35 extend along (and preferably parallel) to stronger score line parts 44.2 of the score line 8. The length L is about 10 mm and the width W is about 1.5-3 mm. The depth is about 0.5 mm. For an optimal stiffening of the speed of scoring it is preferred when these stiffening elements have a form of which the ratio of L/W is greater than 1, preferably greater than 1.5, such as in the range of 2-15, or 5-10.

Figure 16:
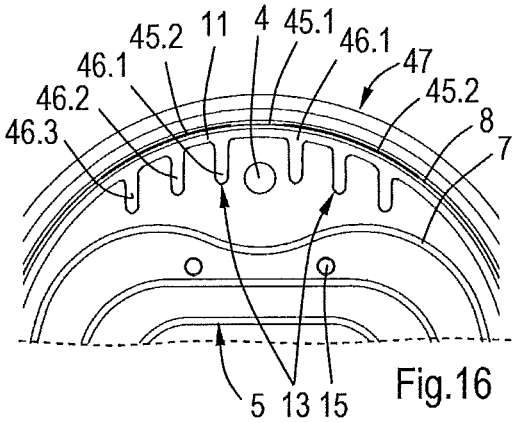
FIGS. 16 and 17 are top views according to FIG. 6 of alternative embodiments with stiffening elements with increased length in a direction away from the rivet.

The embodiment of the closure 47 of the invention shown in FIG. 16, comprises a central score line part 45.1 separating stronger score line parts 45.2 which are neighbored by stiffening means 13 of which the parallel stiffening elements 46.1 to 46.3 in the direction away from the rivet 4 have the same length. But in an alternative the stiffening elements may increase in length in the direction away from the rivet 4. This results in closure areas remote of the rivet 4 having a relatively high stiffness.

Figure 17:
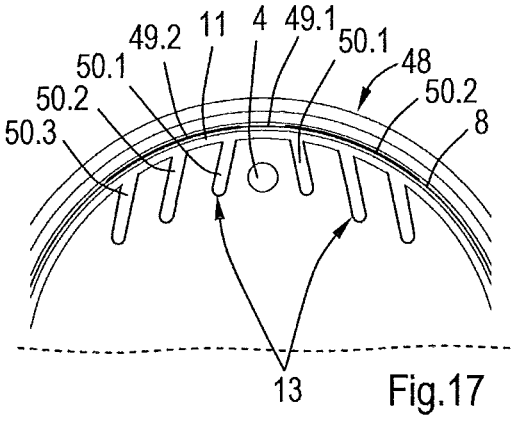

Similarly, the embodiment of the closure 48 shown in FIG. 17, comprising a central score line part 49.1, separating stronger score line parts 49.2 neighbored by stiffening elements 50.1 to 50.3 increasing in length more remote of the rivet 4. These converging stiffening elements 50.1-50.3 increase the stiffness of the areas neighboring the stronger score line parts 49.2, with stiffness increasing in a direction away from the rivet 4.

After having discussed the various embodiments of the stiffening means 13 according to the invention for an easy opening closure, it will be appreciated to the skilled person that the score line 8 may extend along the circumference of the closure thereby dividing after tearing out the score closure part 2 the largest opening in the container. However, the score line may also occupy only a part of the closure thereby forming a smaller opening, when the score line is not a closed line only forming an opening as for instance illustrated by the opening 24 as shown in FIG. 8. Evidently, such closure of the invention may also be present in other types of closures than easy opening closures.

The stiffening means 13 may have the form of stiffening elements being elongated indentations or projections in the closure sidewise of the rivet and extending to inner groove and indirectly to the score line 8 located more radially outwardly of the inner groove, or in absence of the inner groove directly to the score line. In the alternative the stiffening elements may cross and extend beyond the inner groove and at the same time the score line.

Whether or not the various different types of stiffening means may be present, is dependent on the thickness of the closure, of the material of which the closure is made, such as steel, tin plate, aluminum, metal plastic laminates, and the like. Also the diameter of the closure may be taken into consideration, such as diameters varying from 24 to 240 mm, such as 40 to 180 mm, such as 73 mm. Obviously, the presence of step 7, a terrace structure 5, the presence of dimples and other structures may be taken into consideration by the skilled person when deciding what type of stiffening means (20)? according to the invention are to be used in order to reduce the tear force for opening the container while not or substantially not interfering with other structural elements present in the closure. Also the residing subatmospheric pressure in the container before opening is to be considered in the relation to the type, structure and wall thickness of the closure. For standard metal alloys used the wall thickness may be in the range of 0.12 to 0.24 mm, such as 0.14 to 0.20 mm, like 0.16 mm or 0.18 mm. The distance between neighboring stiffening elements at the same side of the rivet may vary between 2-10 mm, or 2-6 mm, such as 3 mm and 4 mm. The width is generally in the range of 0.2-4 mm, such as 0.5-2.5 mm. The depth is generally in the range of 0.2-2 mm, such as 0.3-1 mm.

The skilled person will appreciate that the shape and dimensions of the score line and the stiffening elements depend on the dimensions and material of the closure and on the residing subatmospheric pressure.

The invention claimed is:

1. Closure for a container, comprising, a tab attached by rivet means to a closure part to be displaced for forming an opening in the closure, which opening is at least partly defined by a score line formed in the closure, the tab comprises a tab body connected to the rivet means, a tab rear part for finger gripping, and a tab front part of which a tab nose is located near or at the score line, such that during a closure opening procedure comprising finger gripping the tab rear part, lifting the tab rear part thereby pressing the tab nose against the closure on or near the score line, popping the score line, and scoring the score line thereby forming an opening in the closure, characterized by score line parts separated by a score line part to be popped by the tab nose, which score line parts are stronger than the popping score line part, and by stiffening means stiffening closure parts neighboring the stronger score line parts, and wherein the stiffening means contact or extend beyond the score line.

2. Closure as claimed in claim 1, wherein the stronger score line parts have a residual thickness (r) which is greater than the residual (rp)thickness of the popping score line.

3. Closure as claimed in claim 2, wherein the residual thickness (r) is in the range of 40-90 μm, preferably of 45-80 μm, such as 50-75 μm.

4. Closure as claimed in claim 2, wherein the difference between r and rp is at least 5 μm, preferably at least 10 μm, or 15 μm, such as in the range of 5-40 μm, preferably 10-35 μm, more preferably 15-30 μm.

5. Closure as claimed in claim 2, wherein the stronger score line part has a length in the range of 5-30 mm, preferably 10-20 mm.

6. Closure as claimed in claim 1, wherein the stiffening means comprise at least one elongated stiffening element at both sides of the rivet means, and preferably two or more elongated stiffening elements at both sides of the rivet means.

7. Closure as claimed in claim 6, wherein the elongated stiffening elements are straight.

8. Closure as claimed in claim 7, wherein the straight stiffening elements are parallel to each other at one side of the rivet and preferably the straight stiffening elements are parallel to each other at both sides of the rivet.

9. Closure as claimed in claim 7, wherein the straight stiffening elements converge relative to the straight stiffening elements at the other side of the rivet.

10. Closure as claimed in claim 6, wherein the stiffening elements are curved and/or hooked.

11. Closure as claimed in claim 6, wherein the curved or hooked stiffening elements are concentric, and preferably concentric with the rivet means as the center.

12. Closure as claimed in claim 1, wherein the closure comprises a groove extending radially inwardly along the score line, and the stiffening means extend into or beyond the groove.

13. Closure as claimed in claim 1, wherein stiffening means comprise at least one stiffening element extending parallel to the score line, and the length (L) of the indentation or projection parallel to the score line is greater than width (W) of the indentation or projection, and preferably the ratio of L/W is greater than 1, preferably greater than 1.5, such as in the range of 2-15, preferably 5-10.

14. Container provided with a closure according to claim 1.

15. Container provided with a closure according to claim 13.

16. Closure for a container, comprising a tab attached by rivet means to a closure part to be displaced for forming an opening in the closure, which opening is at least partly defined by a score line formed in the closure, the tab comprises a tab body connected to the rivet means, a tab rear part for finger gripping, and a tab front part of which a tab nose is located near or at the score line, such that during a closure opening procedure comprising finger gripping the tab rear part, lifting the tab rear part thereby pressing the tab nose against the closure on or near the score line, popping the score line, and scoring the score line thereby forming an opening in the closure, characterized by score line parts separated by a score line part to be popped by the tab nose, which score line parts are stronger than the popping score line part, and by stiffening means stiffening closure parts neighboring the stronger score line parts, and wherein the stiffening means comprise at least one elongated stiffening element at each side of the rivet means and the stiffening means contact or extend beyond the score line.

17. Closure as claimed in claim 16, wherein the closure comprises a groove extending radially inwardly along the score line, and the stiffening means extend into or beyond the groove.

* * * * *